US006870504B2

(12) United States Patent
Ikegaya et al.

(10) Patent No.: US 6,870,504 B2
(45) Date of Patent: Mar. 22, 2005

(54) PLATE ANTENNA AND ELECTRIC APPLIANCE THEREWITH

(75) Inventors: Morihiko Ikegaya, Tokyo (JP); Takahiro Sugiyama, Tokyo (JP); Hisashi Tate, Tokyo (JP)

(73) Assignee: Hitachi Cable, Ltd., Tokyo (JP)

( * ) Notice: Subject to any disclaimer, the term of this patent is extended or adjusted under 35 U.S.C. 154(b) by 0 days.

(21) Appl. No.: 10/162,202

(22) Filed: Jun. 5, 2002

(65) Prior Publication Data

US 2003/0184484 A1 Oct. 2, 2003

(30) Foreign Application Priority Data

Mar. 27, 2002 (JP) ..... 2002-088123

(51) Int. Cl.[7] ..... H01Q 1/38
(52) U.S. Cl. ..... 343/700 MS; 343/767; 343/830
(58) Field of Search ..... 343/700 MS, 767, 343/770, 830, 846

(56) References Cited

U.S. PATENT DOCUMENTS

| | | | | |
|---|---|---|---|---|
| 5,600,337 A | * | 2/1997 | Cassel | 343/770 |
| 5,835,063 A | | 11/1998 | Brachat et al. | 343/700 MS |
| 6,650,299 B2 | * | 11/2003 | Zhang et al. | 343/770 |

FOREIGN PATENT DOCUMENTS

| | | | | |
|---|---|---|---|---|
| EP | 0 749 176 | | 12/1996 | |
| GB | 2 345 581 | | 3/1999 | |
| JP | 05-022018 | | 1/1993 | |
| JP | 405243837 A | * | 9/1993 | H01Q/13/20 |
| WO | 00/52784 | | 9/2000 | |

* cited by examiner

*Primary Examiner*—Shih-Chao Chen
(74) *Attorney, Agent, or Firm*—Antonelli, Terry, Stout & Kraus, LLP

(57) ABSTRACT

A plate antenna has a slot formed by incising a conductive plate. A first radiating conductor and a second radiating conductor are formed with a center axis in the length direction of the slot as a border. Power is supplied through opposing two conductive edges which form the slot. The conductive plate is not provided with a dielectric substrate.

18 Claims, 17 Drawing Sheets

PLATE ANTENNA AND ELECTRIC APPLIANCE THEREWITH

BACKGROUND OF THE INVENTION

1. Field of the Invention

The present invention relates to small, thin plate antenna, which can be incorporated in an electric appliance such as portable terminal, electric product or wall or the like, composed of a conductive plate and an electric appliance therewith.

2. Prior Art

Recently, reduction in size of various kinds of special purpose antennas for portable phone, mobile computer and the like (hereinafter referred to as portable terminal), has been progressively executed except a large size antenna for base station, satellite broadcasting and the like. Particularly, the antenna for portable terminal has increased problems in its installation space, that a higher performance is apt to be demanded against the restriction of its antenna volume and other things, accompanied by reduction of the terminal itself. Additionally, radio network concept at home which has been aggressively considered recently, contains the same problem in the size of the antenna with introduction of the antenna into indoor wall surface, personal computer, other electric products and the like (hereinafter, referred to as electric product).

If a dedicated antenna is incorporated in a case or main body case (hereinafter referred to as casing) of a portable terminal or electric product, the above-mentioned problem is generated because a new dedicated space must be secured. Further if reduction in size or weight of the product is accompanied, naturally reduction in volume and weight of the antenna itself is required and thus, a demanded antenna performance is difficult to satisfy. That is, the casing needs an appropriate installation space in order to incorporate the antenna in the casing and secure its performance. Consequently, each specification used up to now need to be changed, so that increase in manufacturing cost of the product orprolongation of development period occurs. For the reason, to avoid this problem, a separate casing is used outside the main body casing in most cases and an externally attached antenna, which is to be attached through an additional cable, is used. However, according to this method, if that portable terminal or electric product is moved, the externally attached antenna must be removed in most cases. Further, labor for reinstallation and readjustment is needed and depending on case, the cable must be placed around or a physical fault due to unexpected trouble may be generated and freedom in the installation position of such a portable terminal or electric product may be restricted, so that user always feels inconvenient with such a plate antenna.

In order to solve these problems, Japanese Patent Application Laid-Open No. HEI5-22018 and Japanese Patent Application Laid-Open No. HEI8-256009 have disclosed typical examples of thin incorporation type antennas which can be incorporated in a gap or the like in a casing of a portable terminal or electric product. These well-known antennas are thin and easy to manufacture. However, in order to obtain a high radiation gain with these well-known antennas, a wide grounding portion is needed, so that consequently, the structure is likely to be increased. To secure a high radiation gain and reduce the size, a grounding portion in the high frequency circuit portion within the casing or a grounding conductor is connected to a grounding portion of the antenna directly with metallic screw or welding in terms of high frequency, so that current distribution on the antenna is allowed to exist on this conductive portion. Finally, these ground portions in the casing need to be used as part of the ground portion of the antenna. That is, in the antenna of the above publication, the ground portion of the antenna needs to be connected to the ground portion in the casing directly through a metallic screw or welding at the antenna installation position or a space portion. Consequently, this type of the antenna is not suitable for demand for reduction in size or weight of the product and if achieved, that product is lack of general-purpose performance.

For the reason, each dedicated antenna, which is to be incorporated in the portable terminal or radio network household product, needs to be introduced easily without increase of manufacturing cost or prolongation of development period and reduce user's inconvenience upon use of that product. Further, the antenna itself needs to be of low cost.

SUMMARY OF THE INVENTION

An object of the present invention is to provide a plate antenna which can be incorporated easily in a portable terminal, electric appliance, wall and the like with a small space, and achieves an excellent general-purpose performance at a low cost and a high radiation efficiency with a single unit without using a grounding conductor in the portable terminal or electric appliance casing as part of the antenna.

To achieve the above object, the present invention provides a plate antenna wherein a slot is formed by incising a conductive plate, a first radiating conductor and a second radiating conductor are formed with a center axis in the length direction of the slot as a border and power is supplied through opposing two conductive edges which form the slot.

Preferably, the conductive plate is formed separately from a grounding portion in a high frequency circuit portion in the appliance in which the antenna is loaded or incorporated or a grounding conductor provided in the appliance.

Preferably, the slot is formed on a position deflected from the center of the conductive plate and the second radiating conductor has a larger area than the first radiating conductor.

Preferably, the dimension of the first radiating conductor corresponding to the length direction of the slot is set to substantially odd times ¼ the wavelength of electric wave for use.

Preferably, the width of the slot is set to less than ⅛ the wavelength of electric wave for use.

The wavelength of electric wave mentioned here refers to the wavelength of electromagnetic wave for use in transmission by a radio appliance loaded with the plate antenna of the present invention.

The opposing conductive edges of the aforementioned slot do not always have to be parallel at an equal distance.

It is permissible to extend parts of opposing conductive edges of the slot inward of the slot and supply power to the extended conductive portions.

While the conductive plate is formed on an insulating basement, parts of the opposing conductive edges of the slot may be extended downward of the basement and electrically connected to a wiring pattern formed on a high frequency circuit board.

Preferably, the aforementioned conductive plate is covered entirely with insulating material in laminate. In the meantime, the insulating material is removed from the power supplying portion, which supplies power to the slot. In this case, considering an influence of dielectric constant of the laminate material (dielectric material), which is an insulating material, the size of each part of the antenna needs to be slightly smaller with respect to the wavelength of electric wave for use, than in case where no laminate material is applied.

Use of the insulating material enables to secure a structure easily, in which the aforementioned plate antenna is not connected to an outside grounding portion in terms of high frequency. Further, because the characteristic of a single plate antenna unit can be maintained easily for the reason, its general-purpose performance can be raised.

It is permissible that a coaxial cable comprised of an inside conductor formed of a single wire or plural stranded wires and an outside conductor located on an outer periphery of the inside conductor acts as a power supply cable, while the inside conductor and outside conductor on an end of the coaxial cable are connected to opposing two conductive edges forming the slot.

When connecting the conductive edges to the inside conductor and outside conductor of the coaxial cable in order to supply power to the slot, it is permissible to select not only connection by melting with conductive solder but also connection with connector or the like depending upon the purpose.

The power supply position to the slot is preferred to be determined considering impedance matching.

Preferably, the aforementioned plate antenna is used in the state in which it is installed inside the electric appliance. If it is intended to load or incorporate plural plate antennas on or in an electric appliance, preferably, they are disposed such that the edges of respective plate conductors do not oppose each other.

The plate antenna of the present invention is as small and thin as can be installed in a gap in a portable terminal, a casing of electric product, wall and the like and excellent in cost and general-purpose performance. According to the structure of the present invention, a first monopole antenna is formed with the first radiating conductor while a second monopole antenna, which has a different current flow direction from the first monopole antenna, is formed with the second radiating conductor. Thus, a high radiation efficiency is achieved without using a grounding portion in the high frequency circuit portion within a casing in which the plate antenna is loaded or incorporated or a grounding conductive portion provided in the casing as part of the antenna, so that two monopole antennas, which intersect each other and are well balanced, are achieved. Thus, if it is intended to load or incorporate the plate antenna of the present invention, non-directivity regardless of the direction of the appliance can be achieved.

Further, incase where other antenna is disposed in the vicinity of the plate antenna of the present invention, this antenna can control the directivity characteristic by changing a balance between a side which opposes the other antenna and a side which does not oppose not so as to generate an interference with the other antenna. Thus, installation interval relative to other antenna can be reduced without destroying the antenna characteristic largely.

DESCRIPTION OF THE PREFERRED EMBODIMENTS

Hereinafter, the preferred embodiments of the present invention will be described with reference to the accompanying drawings.

Figure 1:
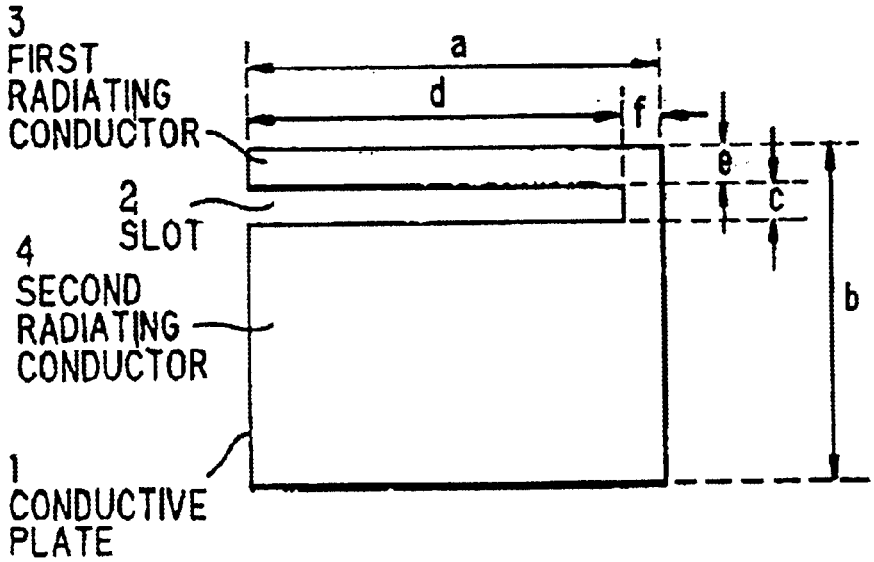
FIG. 1 is a structure diagram of a conductive plate for use in the plate antenna of the present invention.

The feature of the plate antenna of the present invention will be described with reference to FIGS. 1 and 2. In the plate antenna of the present invention, as shown in FIG. 1, a slot 2 is formed in a conductive plate 1 having the width a and length b, the slot 2 having the width c and the length d and being open at one end. With the center axial line in the length direction of this slot 2 as a border, a first radiating conductor 3 and a second radiating conductor 4 are formed. The slot 2 is formed at a position deflected from the center of the conductive plate while the second radiating conductor 4 has a larger area than the first radiating conductor 3. The width a of the conductive plate 1 is substantially odd times ¼ the wavelength of electric wave for use. In case where the frequency of electric wave for use is in 2.4 GH band, the wavelength of the electric wave at this time is about 120 mm. ¼ that wavelength is about 30 mm and this length is the width a of for example, the conductive plate 1. The wavelength of the electric wave for use refers to the wavelength of electromagnetic wave which a radio appliance loaded with the plate antenna of the present invention uses for communication. Further, the width c of the slot 2, the width e of the first radiating conductor 3 and the width f of a conductive portion on a border between the first radiating conductor 3 and the second radiating conductor 4 are determined depending upon a required antenna characteristic.

The conductive plate 1 is not connected to an outside grounding portion in terms of high frequency. Being not connected in terms of high frequency means that the plate antenna of the present invention has no conductive portion which always has an equal potential to the outside grounding portion. That is, if the plate antenna of the present invention is loaded or incorporated in an electric appliance, the plate antenna is electrically connected to a high frequency circuit portion constituting the transmitting/receiving circuits of the electric appliance only through a power supply line, but the conductive plate 1 is not in contact with or connected directly to the grounding conductive portion in that appliance, so that they are independent of each other. Actually, if the plate antenna of the present invention is installed on the casing of communication electric appliance represented by the note type personal computer, PDA or the like, that plate antenna is covered entirely with insulation film such as laminate material or conductor is eliminated from around the plate antenna, so that high-frequency connection between the conductive portion in the appliance and the grounding portion is insulated.

Figure 2:
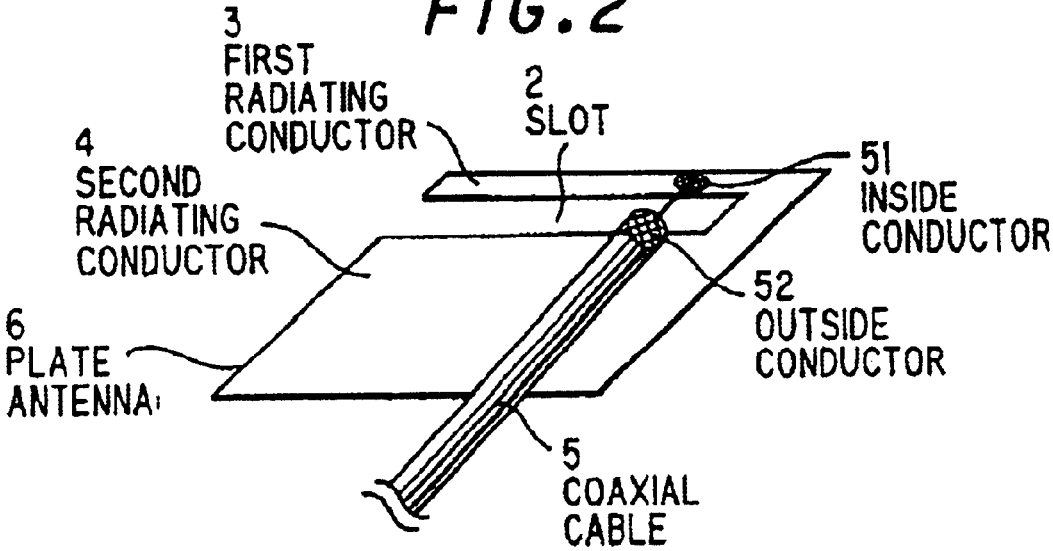
FIG. 2 is a structure diagram of the plate antenna of the present invention.

As an example of power supply method to the slot 2, as shown in FIG. 2, part of the first radiating conductor 3 constituting the slot 2 at a position considering impedance matching is connected to an inside conductor 51 in a coaxial cable 5 while an outside conductor 52 of the coaxial cable 5 is connected to part of the second radiating conductor 4. These connections may be carried out by fusion with conductive solder or using a special connector or stay having a configuration capable of maintaining conductivity. As indicated in an embodiments described later, other power supply methods such as contact type, circuit board installation type may be used by modifying its power supply structure.

Although in FIG. 2, part of the first radiating conductor 3 is connected to the inside conductor 51 of the coaxial cable 51 while the outside conductor 52 of the coaxial cable 5 is connected to part of the second radiating conductor 4, it is permissible to replace the inside conductor 51 with the outside conductor 52. This is the same in embodiments described later.

Figure 3:
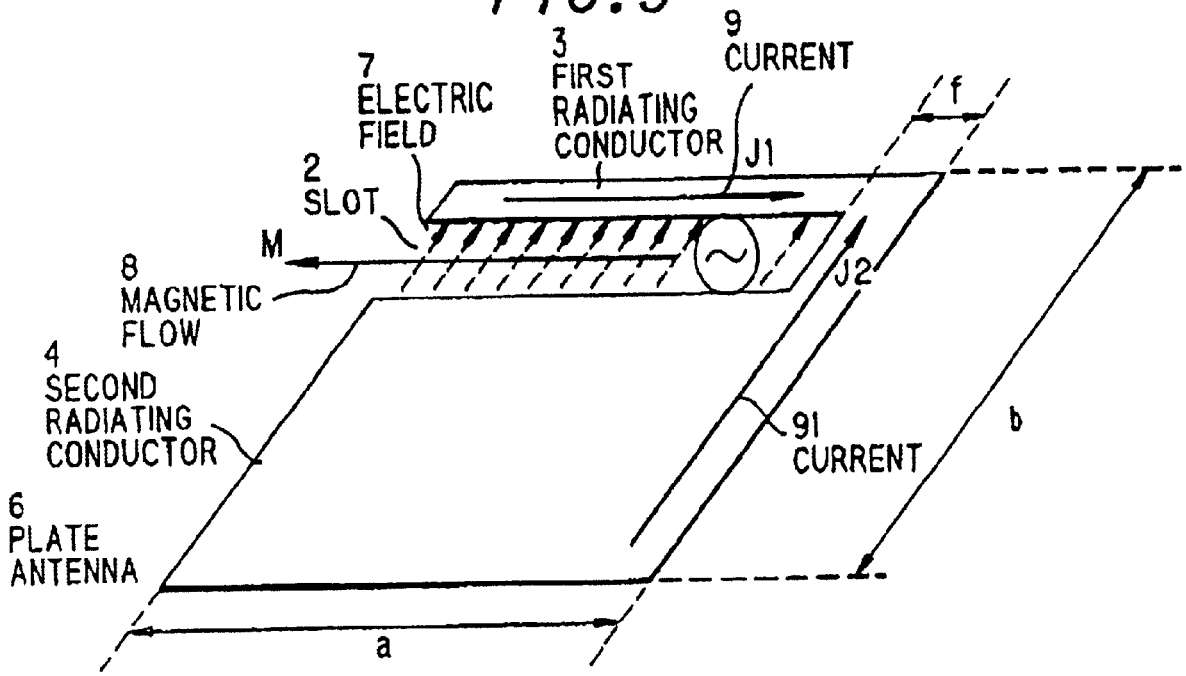
FIG. 3 is an electrical structure diagram of the plate antenna of the present invention.

When power is supplied to the slot 2 of FIG. 2, electric field 7 is generated between the first radiating conductor 3 and the second radiating conductor 4 which oppose each other in the slot 2 as shown in FIG. 3, so that magnetic flow (M) is generated in the direction of an opening of the slot 2 perpendicular thereto. Consequently, the slot 2 functions as an antenna. Further, current (J1) 9 is generated in the first radiating conductor 3 in the length direction thereof while current (J2) 91 is generated on the second radiating conductor 4 in the length direction thereof (length direction of the conductive plate 1). As a result, the first radiating conductor 3 and the second radiating conductor 4 function as individual monopole antenna because of these currents 9, 91. As described above, the plate antenna 6 of the present invention includes a slot antenna and two monopole antennas, those being electrically constructed on the same conductor plate. The length of the monopole antenna (length b of the conductor plate), which is constructed by current 91 on the second radiating conductor 4, contributes to standing wave of current 91 and the impedance of an entire plate antenna 6. By adjusting the width a and the height b of this plate antenna 6, electric matching between the first and second radiating conductor scan be determined. Further, this plate antenna is capable of adjusting electric power radiation of the slot antenna due to magnetic flow (M) 8 by adjusting the width (e in FIG. 1) of the first radiating conductor 3, and depending upon the purpose, this antenna may be constructed with only electric power radiation with the two monopole antennas by the current (J1) 9 and current (J2) 91 while suppressing electric power radiation through the slot antenna.

Figure 4:
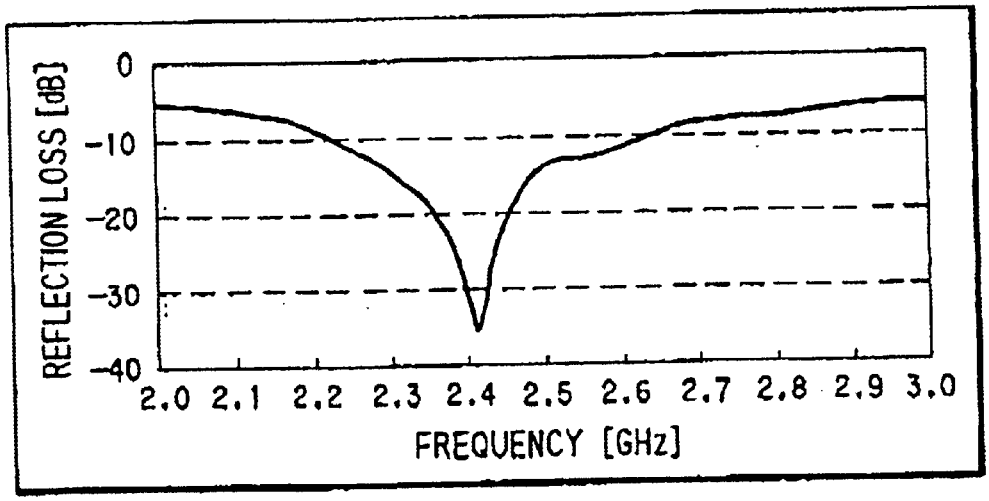
FIG. 4 is a diagram showing the excitation characteristic of the plate antenna of the present invention.

Next, FIG. 4 shows the excitation characteristic in case where the width a and the length b of the plate antenna 6 are equalized with each other. In this case, the frequency band was 2.4 GHz and corresponding to the wavelength of electric wave in this frequency band, respective dimensions of the plate antenna were such that a=32 mm, b=32 mm, c=2 mm, d=29 mm, e=2 mm, f=3 mm and then, a conductive plate 0.2 mm thick was used. In the meantime, these dimensions come from an example of the structure which suppresses electric power radiation through the slot antenna and radiates electric power through two monopole antennas. Power supply to the plate antenna is carried out through a small-diameter coaxial cable having the diameter of 0.8 mm and this cable is soldered according to the method shown in FIG. 2. The excitation characteristic at this time is as shown in FIG. 4, such that 2 or less in voltage standing-wave ratio (VSWR) (return loss: about −10 dB or less) is achieved in a wide band.

Figure 5A:
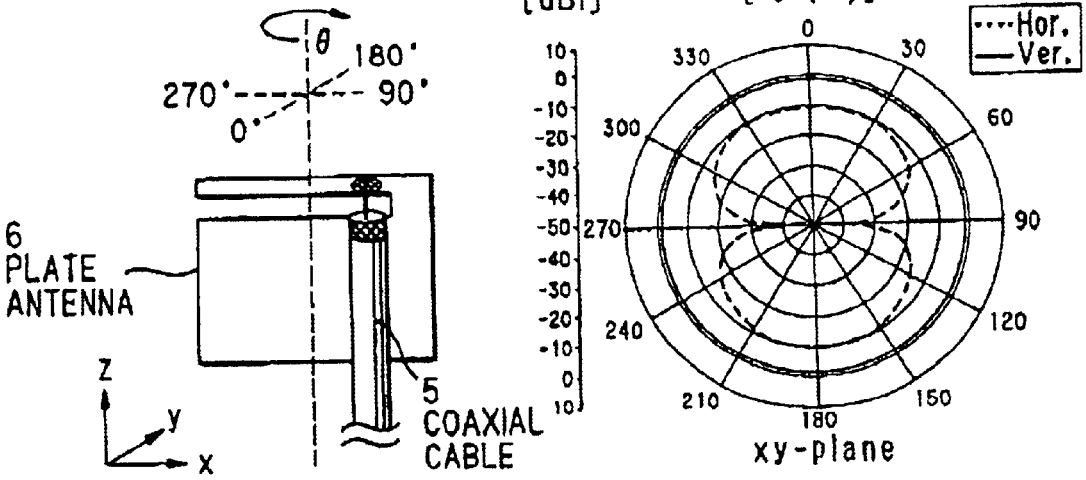
FIG. 5 is a diagram showing the directivity characteristic of the plate antenna of the present invention.
Figure 5B:
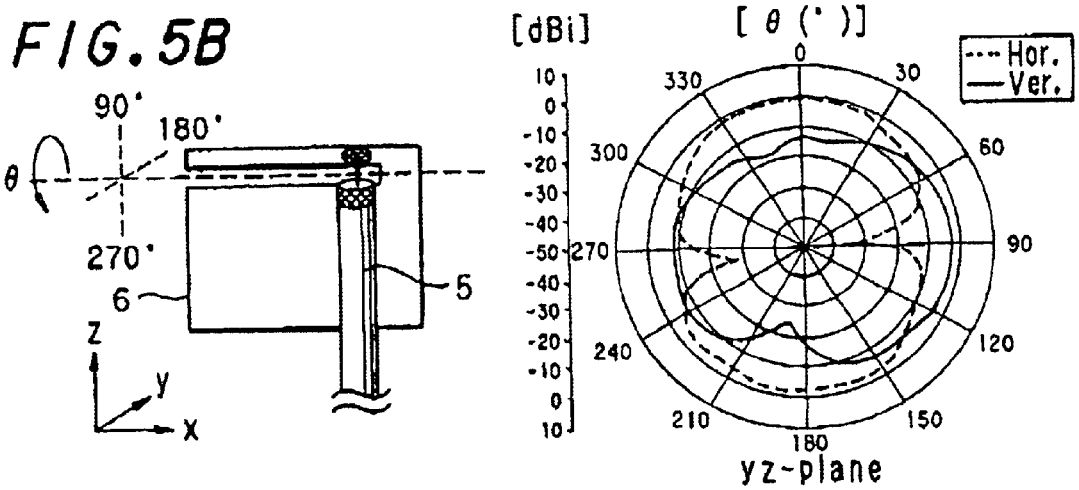
Figure 5C:
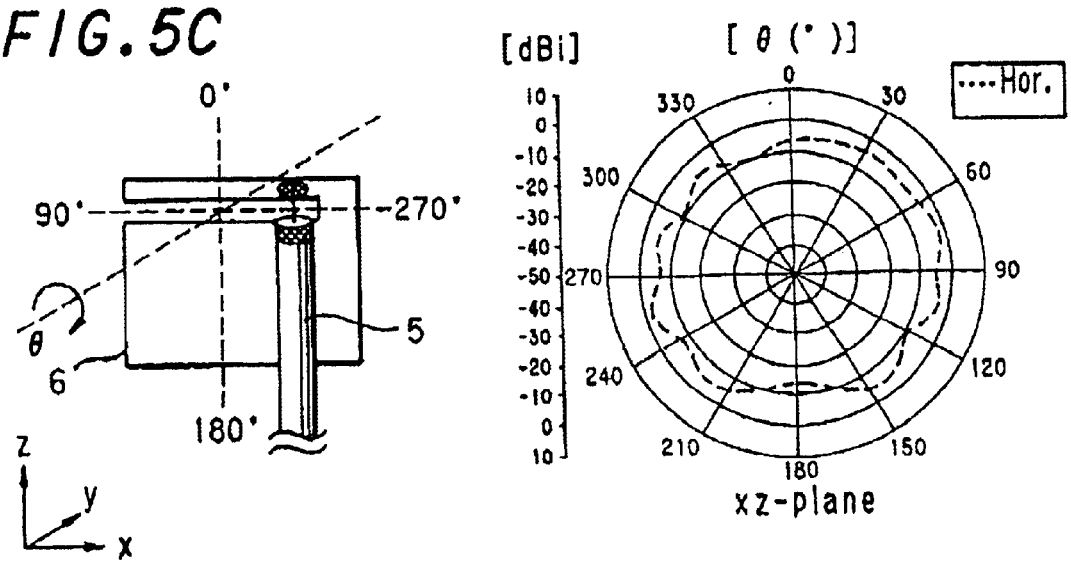

Next, FIG. 5 shows the directivity characteristic in the structure of FIG. 4. FIG. 5 indicates the state in which the plate antenna of the present invention is placed on a plane yz of coordinate system with horizontal polarized radiation (Hor.) and vertical polarized radiation (Ver.) separately. FIG. 5(*a*) indicates the directivity characteristic on plane xy by turning the z-axis, FIG. 5(*b*) indicates the directivity characteristic on plane yz by turning the x-axis and FIG. 5(*c*) indicates the directivity characteristic on plane xz by turning y-axis. Vertical polarized radiation by J1 and horizontal polarized radiation by J2 in FIG. 3 appear on plane xy of (a). Next, on plane yz of (b), vertical polarized radiation by J1 and horizontal polarized radiation by J2 in FIG. 3 appear. Then, horizontal polarized radiation by J1 and J2 in FIG. 3 appear on plane xz of (c). According to results of the respective Figures, the plate antenna 6 achieves an excellent transmission/receiving characteristic without null point by combining horizontal polarized radiation and vertical polarized radiation in all directions on the planes xy, yz, xz (although there exists null point if horizontal polarized radiation and vertical polarized radiation are regarded separately, the null point vanished if both are regarded in combination). Meanwhile, it has been well known that the conventionally known antenna is incapable of achieving an excellent directivity characteristic on all planes or in all directions unlike the plate antenna 6.

Further, the directivity characteristic of FIG. 5 can be inclined depending upon its application purpose by adjusting the width a or the length b of the plate antenna 6 with respect to the length (d in FIG. 1) of the slot. Its detail will be described in the embodiments of the present invention described later.

Although according to this embodiment, the direction of current is parallel to the direction of the magnetic flow 8 while the direction of current 91 is perpendicular thereto, if the conductor portion on a border between the first radiating conductor 3 and the second radiating conductor 4, formed across the center axis in the length direction of the slot 2, is formed obliquely, current 91 flows along it, so that the direction of the magnetic flow 8 does not coincide with the direction of current 91.

Figure 6:
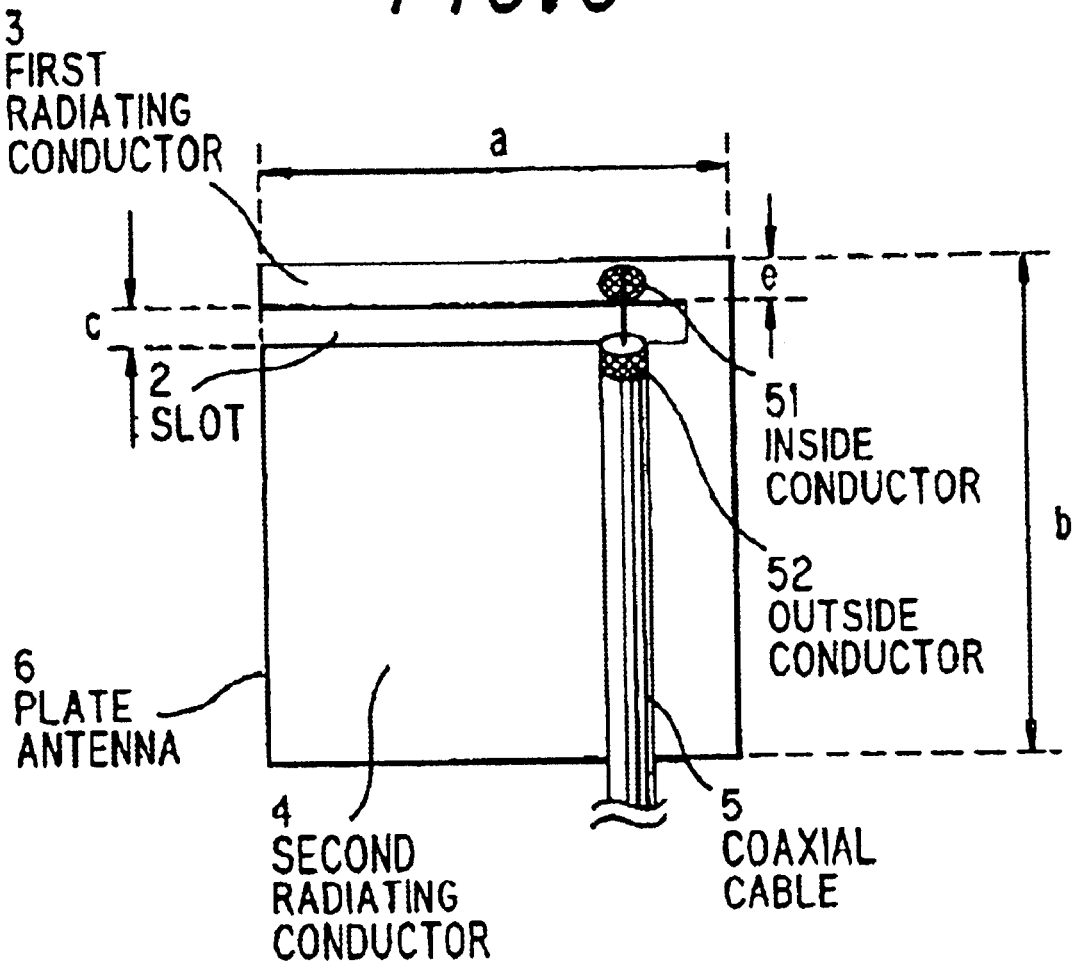
FIG. 6 is a structure diagram of the plate antenna of the present invention.
Figure 7:
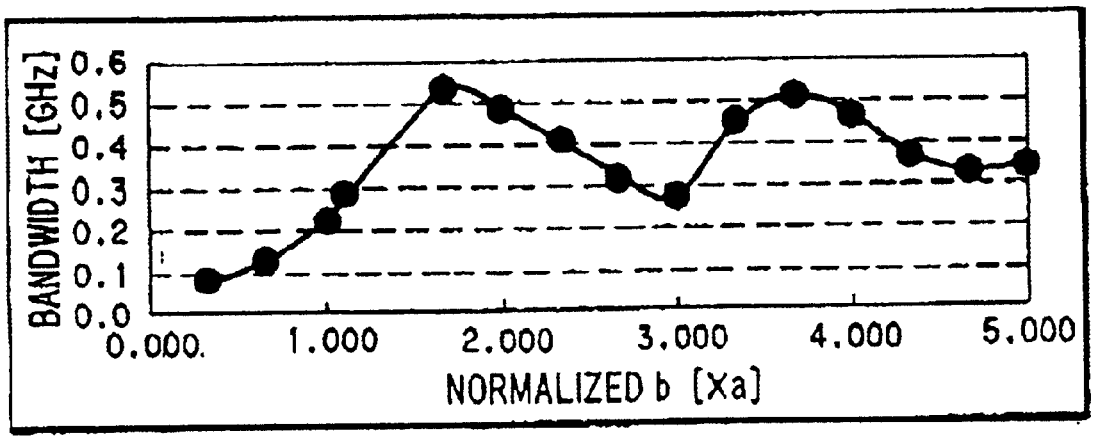
FIG. 7 is a diagram showing the bandwidth accompanied by changes in the structure of the plate antenna of the present invention.
Figure 8:
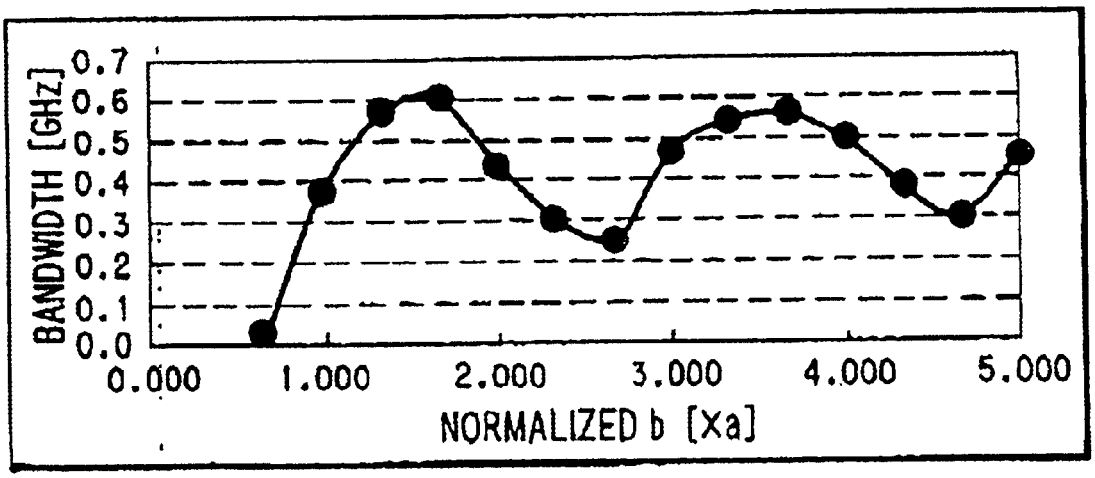
FIG. 8 is a diagram showing bandwidth accompanied by changes in the structure of the plate antenna of the present invention.

Next, FIGS. 6 to 8 show changes in bandwidth (2 or less in terms of VSWR) when the length b of the plate antenna 6 of the present invention is changed, in order to indicate the feature of bandwidth change due to electrical matching between the first and second radiating conductors in the plate antenna 6. In the structure of FIG. 6, with the width e of the first radiating conductor 3 and the width c of the slot 2 fixed, not only the connecting position between part of the first radiating conductor 3 and the inside conductor 51 of the coaxial cable 51 but also the connecting position between the outside conductor 52 of the coaxial cable 5 and the second radiating conductor 5 are fixed and then the length b of the plate antenna 6 is changed. FIG. 7 shows changes in bandwidth of this case. From FIG. 7, it is clear that the bandwidth vibrates and changes cyclically. This is an effect due to changes of standing wave of current (J2) 91 shown in FIG. 3. However, as a result of FIG. 7, peak frequency of excitation moves due to changes in impedance accompanied by changes in the standing wave. Therefore, next, the connecting position between part of the first radiating conductor 3 and the inside conductor 51 of the coaxial cable 5 and the connecting position between the outside conductor 52 of the coaxial cable 5 and the second radiating conductor 4 are adjusted with changes in the length of the plate antenna 6. FIG. 8 shows the result of evaluation carried out with the peak frequency of excitation fixed at this time. In FIG. 8, the bandwidth vibrates and changes like FIG. 7 and the change is more cyclic. This characteristic is an effect due to changes in the standing waves in the current (J2) 91. From the above-described results, it is evident that the plate antenna is capable of determining the bandwidth easily by using electrical matching between the first and second radiating conductors. Although the results of FIGS. 7 and 8 may be slightly different from each other because of the frequency for use or the size of the antenna itself, the basic characteristic is not changed.

Figure 9:
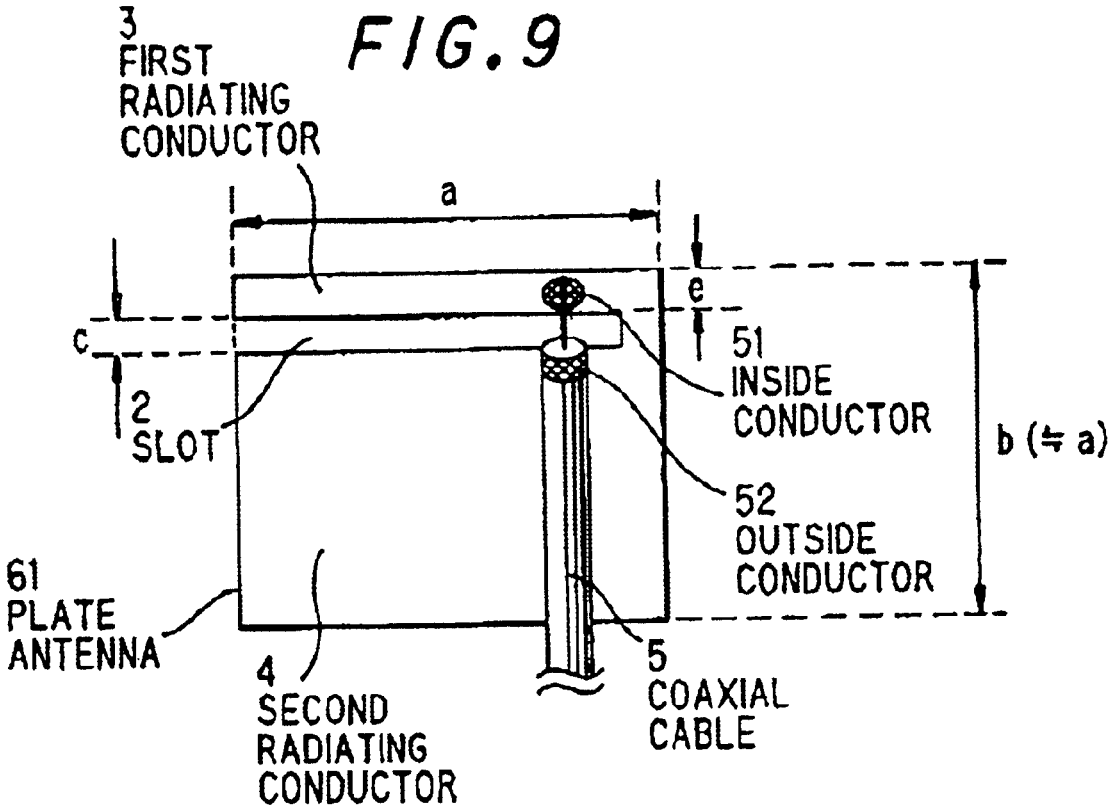
FIG. 9 is a structure diagram of the plate antenna of the present invention.
Figure 10:
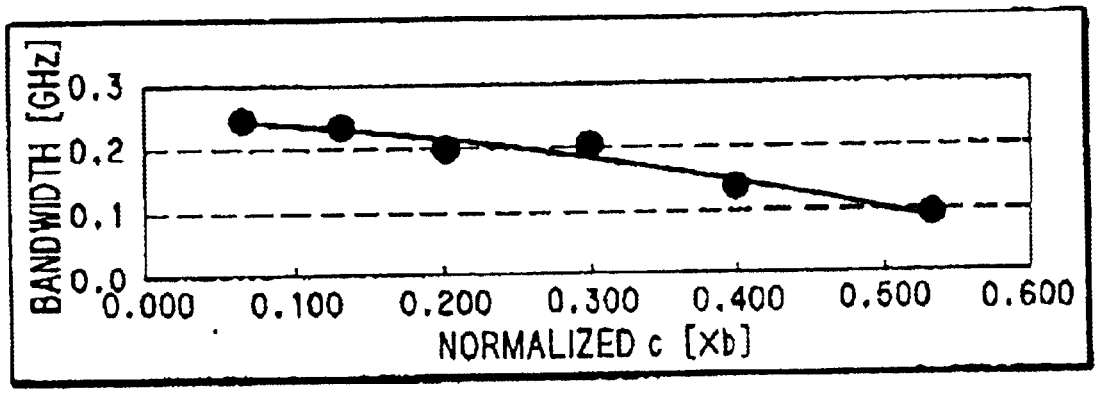
FIG. 10 is a diagram showing bandwidth accompanied by changes in the structure of the plate antenna of the present invention.
Figure 11:
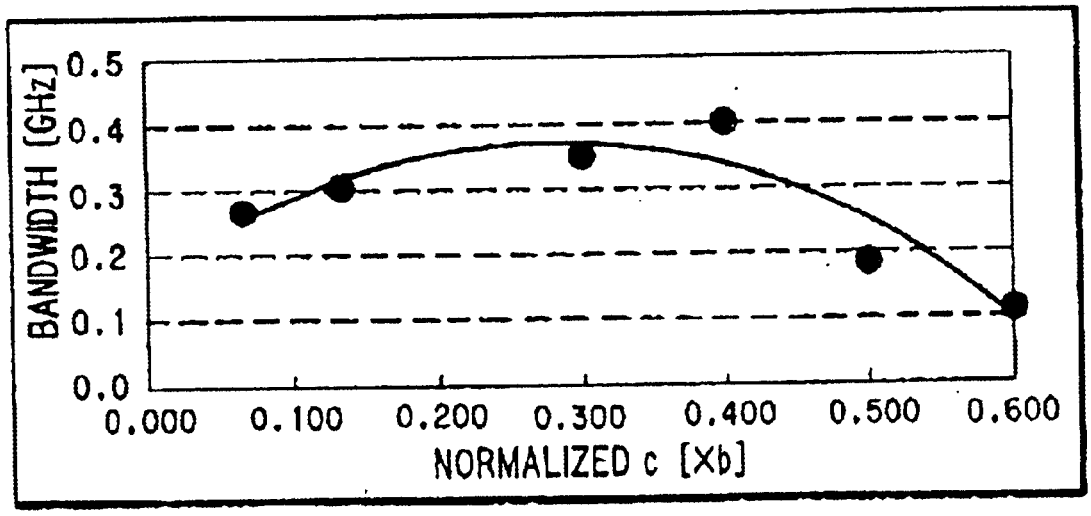
FIG. 11 is a diagram showing bandwidth accompanied by changes in the structure of the plate antenna of the present invention.

Next, FIGS. 10 and 11 show changes in bandwidth (2 or less in terms of VSWR) when the width c of the slot 2 of the plate antenna 6 of FIG. 9 is changed, in order to indicate the feature of changes in the bandwidth due to the width c of the plate antenna 6 of the present invention. FIG. 10 shows changes in the bandwidth in case where the width c of the slot 2 of the plate antenna 6 is changed with the width e of the first radiating conductor 3 fixed and further, the connecting position between part of the first radiating conductor 3 and the inside conductor 51 of the coaxial cable 5 and the connecting position between the outside conductor 52 of the coaxial cable 5 and the second radiating conductor 4 also fixed in the structure shown in FIG. 10. In the meantime, the width a and the length b of the plate antenna are equal to each other and the size thereof is determined with reference to a case whose result in FIG. 8 is excellent. From FIG. 10, it is evident that the bandwidth decreases with an increase of the width c of the slot 2. In case of FIG. 10, it has been known that the change in impedance is larger than case of FIG. 7 and the deflection of the peak frequency of excitation is increased with the change of the width c of the slot 2 from experiments. Thus, next the connecting position between part of the first radiating conductor 3 and the inside conductor 51 of the coaxial cable 5 and the connecting position between the outside conductor 52 of the coaxial cable 5 and the second radiating conductor 4 are adjusted with the change of the width c of the slot 2. FIG. 11 shows the result of evaluation carried out with the peak frequency of excitation fixed at this time. FIG. 11 indicates that the change of the bandwidth decreases with an increase in the width c of the slot 2. Further, it is also evident that a proper bandwidth is maintained even if the width c of the slot 2 becomes about half the length b of the plate antenna 6. That is, it is clarified that the plate antenna 6 is capable of maintaining the bandwidth easily by electrical matching of the first and second radiating conductors even if the width c of the slot 2 is increased. In the meantime, although the results of FIGS. 10 and 11 may be slightly different from each other depending on the frequency for use and the size of the antenna itself, the basic characteristic is not changed.

Although according to this embodiment, the frequency band is 2.4 GHz, the plate antenna of the present invention is capable of corresponding to any frequency theoretically if the width a of the conductive plate is substantially ¼ the wavelength of electric wave belonging to that frequency band. Because the width a needs to be increased as the frequency band decreases, particularly if incorporation of the antenna in household appliance or portable terminal is considered, the frequency for use is preferred to be 0.1 GHz or more (the length ¼ the wavelength at this time is about 750 mm) from viewpoints of the size of the plate antenna.

From the results of FIGS. 7 to 11, it is clarified that the plate antenna 6 has the structure capable of maintaining its effective bandwidth despite more or less change in the structure if the size thereof is determined so as to maintain electrical matching between the first and second radiating conductors and power supply position to the slot is considered. Further, from these results, it can be said that the present invention ensures a wide freedom in determining the structure and provides a structure capable of corresponding easily to an installation space by combining evident effects.

Further, if one end of the coaxial cable used in the plate antenna of the present invention is connected to a power supply circuit provided additionally in a product incorporating the plate antenna or its relay circuit so as to provide it with a function as the power supply circuit, a small, thin plate antenna having a high general-purpose property and a large installation freedom is achieved.

Because the coaxial cable is employed as the power supply line, this power supply line may be placed around freely within the appliance such that it is never an obstacle to other devices disposed internally.

From the reason, the present invention does not need a large modification to the specification about a casing of a radio network household product and an installation position of each component and the present invention can be incorporated in a small space like a gap in the casing, so that a high performance antenna can be realized at low costs.

If the above-described plate antenna is installed inside a portable terminal or household radio network appliance, inconvenience which user always feels because of removal of an externally attached antenna, reinstallation and readjustment when such a product is moved, or placing cables around or fault which maybe caused by unexpected trouble, is eliminated. Further, freedom on selection of a product installation position can be increased by the high-quality characteristic of the present invention.

Hereinafter, embodiments of the present invention will be described with reference to respective diagrams.

FIRST EXAMPLE

Figure 12:
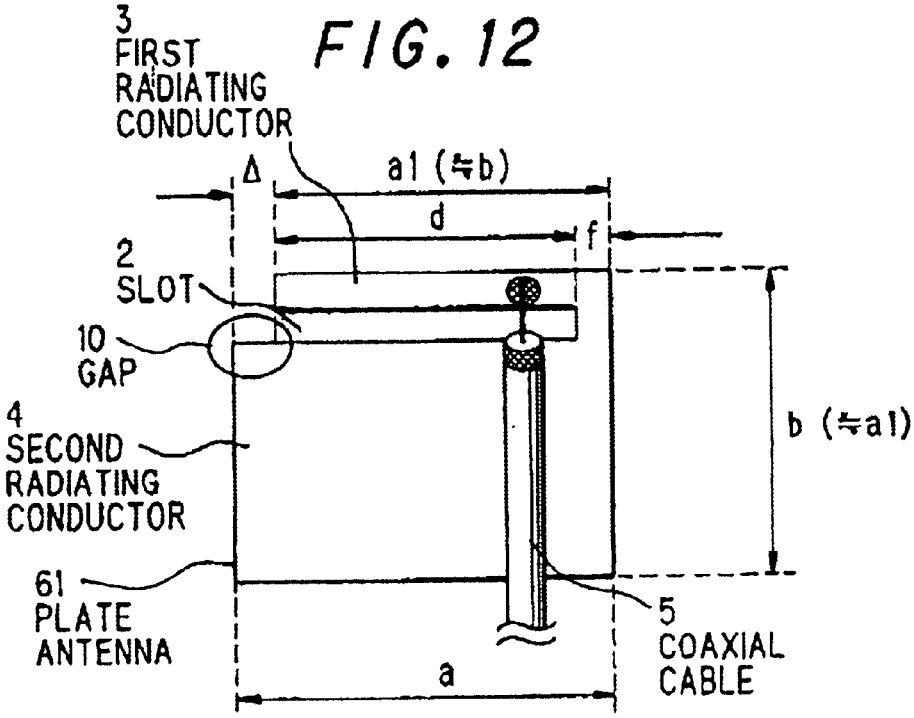
FIG. 12 is a structure diagram of the plate antenna according to a first embodiment of the present invention.
Figure 13:
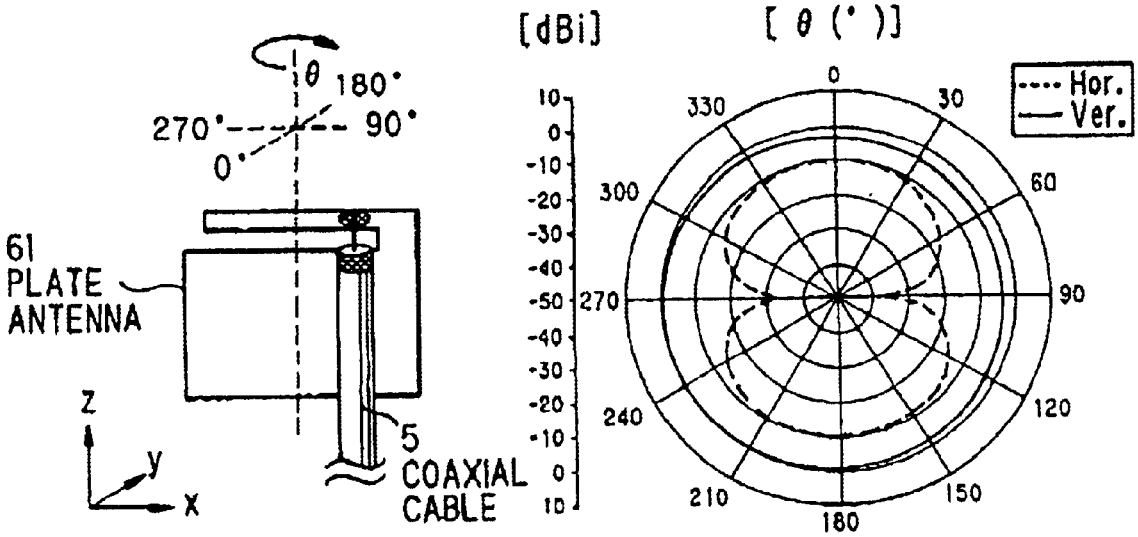
FIG. 13 is a diagram showing the directivity characteristic of the plate antenna according to the first embodiment of the present invention.
Figure 14:
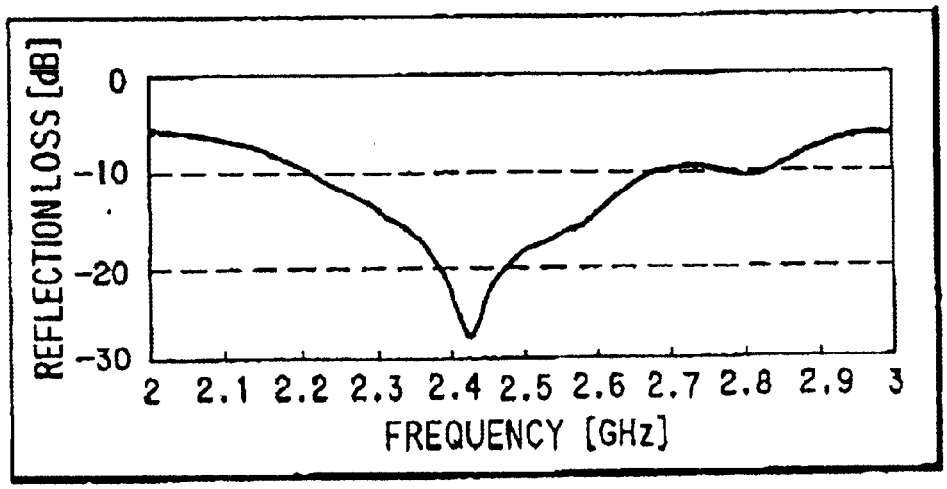
FIG. 14 is a diagram showing the excitation characteristic of the plate antenna according to the first embodiment of the present invention.

A first embodiment of the present invention will be described with reference to FIGS. 12 to 14. FIG. 12 shows the antenna structure in case where in the plate antenna 61 of the present invention, the length of the first radiating conductor 3 having a length a1, which is a sum of the length d of the slot 2 and the width f of a conductive portion on a border between the first radiating conductor 3 and the second radiating conductor 4 is set to the length b of the plate antenna while the width a of the plate antenna is larger than the length a1. At this time, the length a1 is substantially ¼ the wavelength of electric wave for use. Because there exists a portion 10 having a difference a (hereinafter defined as gap) between the length a1 and the width a of the plate antenna 6, electromagnetic field generated in the slot 2 is inclined corresponding to the size of the gap 10 in order to ensure its own matching. As a result, although if there is no gap 10, the directivity indicated in FIG. 5 is provided, according to this example, the directivity can be shifted in such a direction that the gap 10 exits as shown in FIG. 13. At this time, the excitation characteristic is as shown in FIG. 14, so that a wide effective band is obtained. Further, by operating the size a of this gap 10, the directivity of FIG. 13 can be shifted further.

SECOND EXAMPLE

Figure 15:
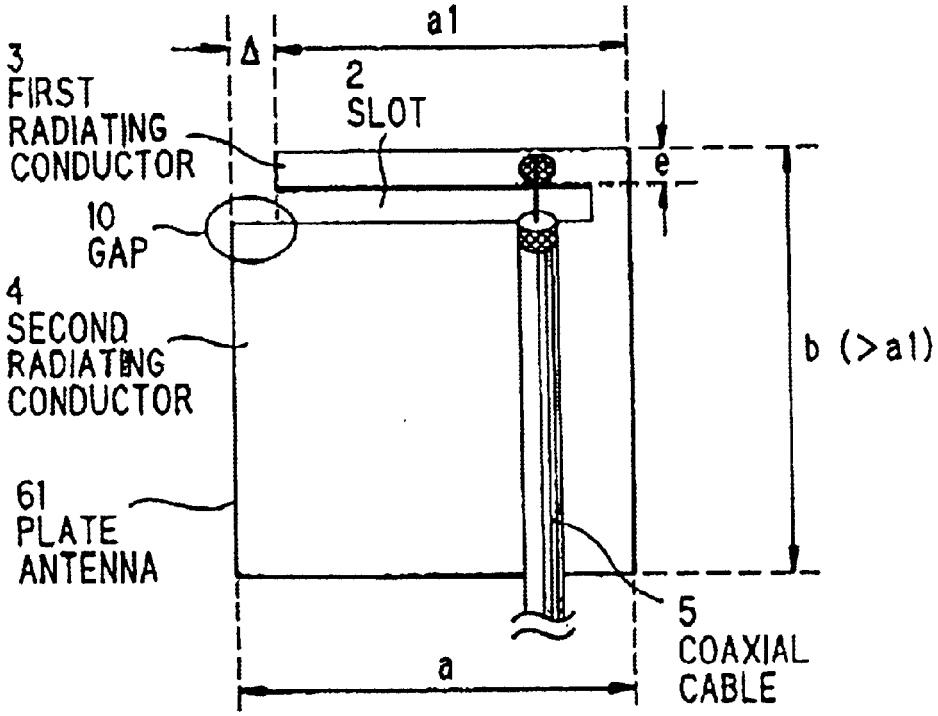
FIG. 15 is a structure diagram of the plate antenna according to a second embodiment of the present invention.
Figure 16:
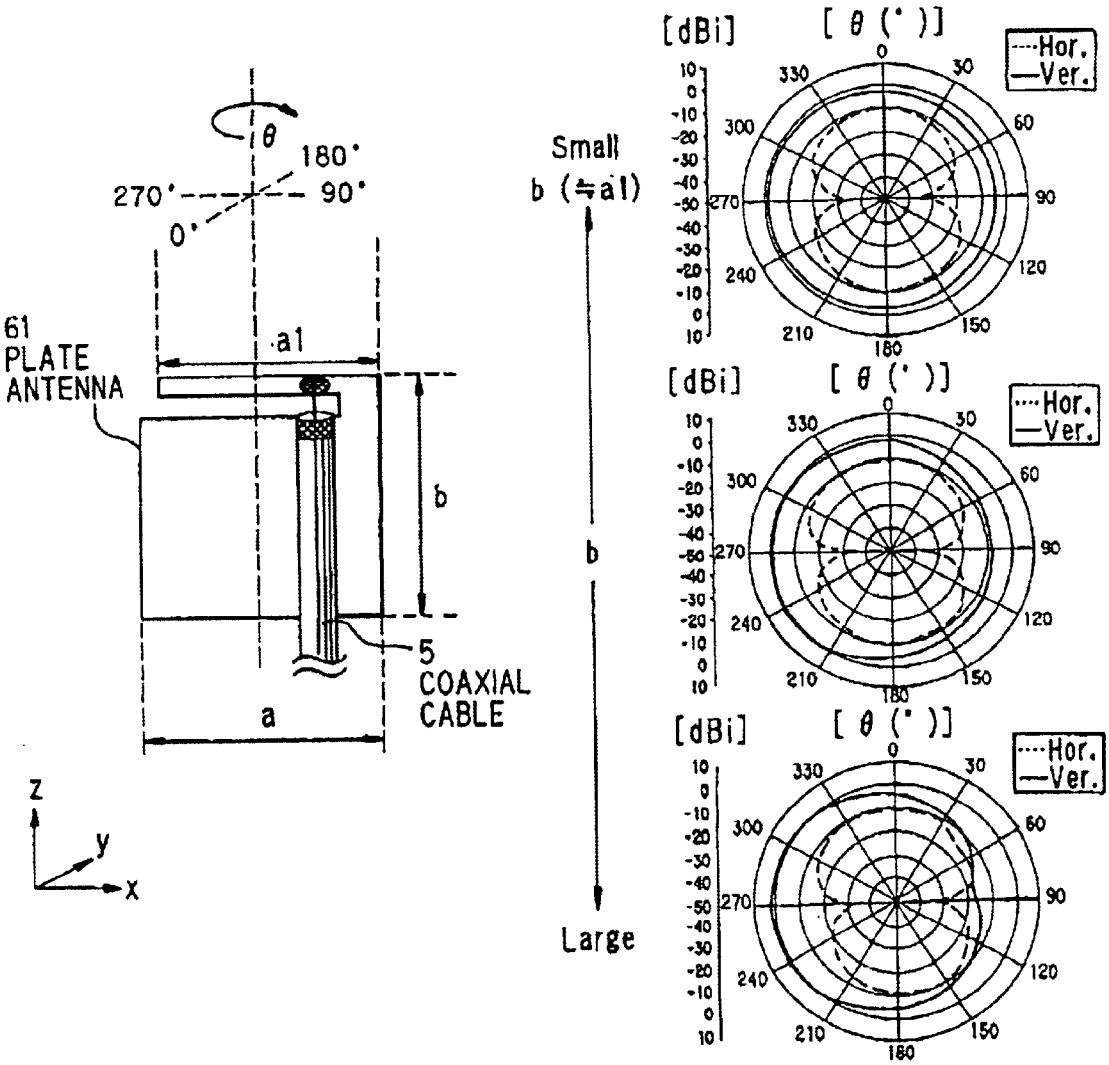
FIG. 16 is a diagram showing the directivity characteristic of the plate antenna according to the second embodiment of the present invention.

A second embodiment of the present invention will be described with reference to FIGS. 15 and 16. FIG. 15 shows an example in which under the structure of the first embodiment, the length b of the plate antenna 61 is changed with the width e of the first radiating conductor 3 fixed. In this case, the standing wave of the current (J2) 91 shown in FIG. 3 changes with changes in the length b of the plate antenna 61, so that the electromagnetic field component inclined by the gap 10 in the slot 2 can be inclined further. As a result, it is evident that, with changes in the length of the plate antenna 61 as shown in FIG. 16, the directivity is shifted in a direction that the gap 10 exists like the first embodiment and further the directivity in a direction that no gap 10 exists can be suppressed. That is, the directivity of the plate antenna 61 can be controlled by the length of the plate antenna 61. In the meantime, although the excitation characteristic at this time is obtained in a wide effective band like the first embodiment, representation thereof is omitted here.

THIRD EXAMPLE

Figure 17A:
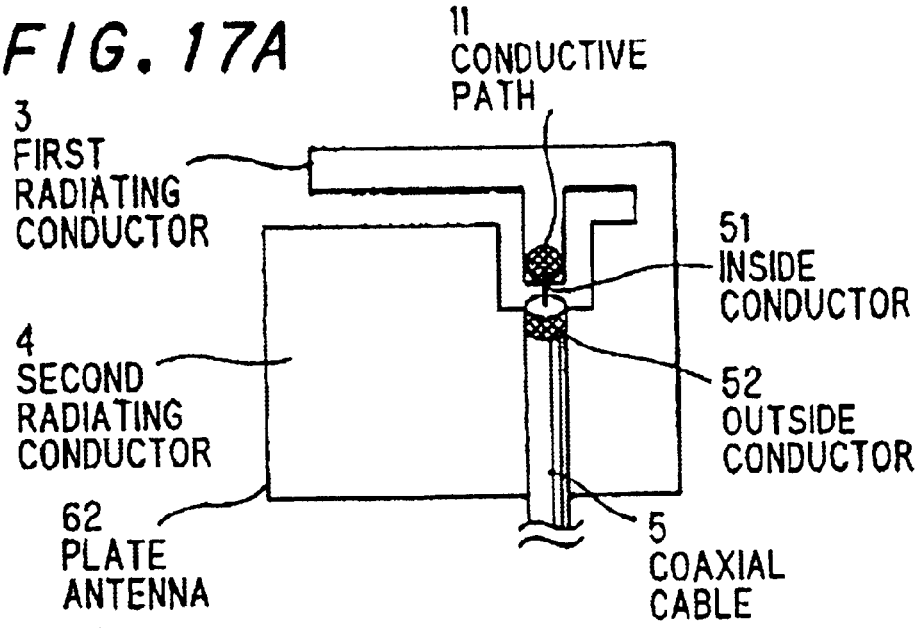
FIG. 17 is a structure diagram of the plate antenna according to a third embodiment of the present invention.
Figure 17B:
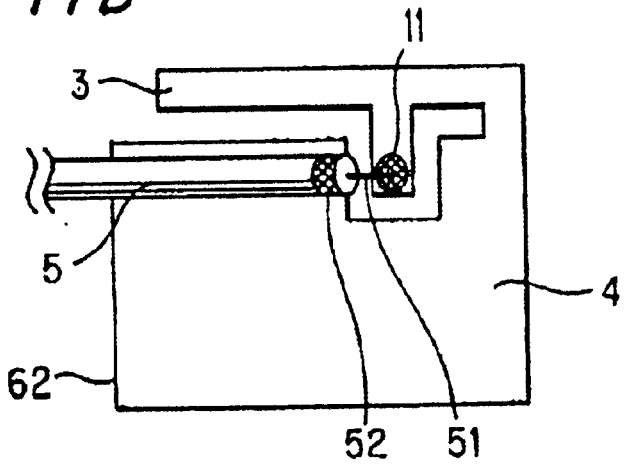
Figure 17C:
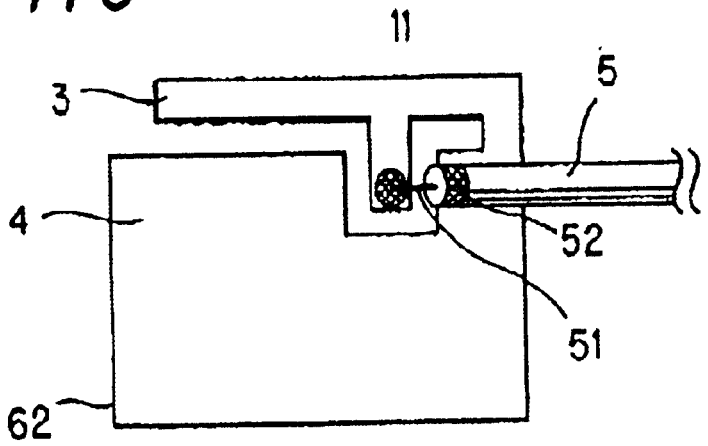

A third embodiment of the present invention will be described with reference to FIG. 17. FIG. 17 shows a plate antenna 62 produced by modifying the power supply structure of the plate antenna 61 of the present invention shown in the examples 1, 2. A conductor path 11 is extended toward the second radiating conductor 4 from a position in which impedance matching is considered of the first radiating conductor 3 and then, this conductor path 11 is connected to the inside conductor 51 in the coaxial cable 5. Further, in the second radiating conductor 4, a cutout portion is formed so that the conductor path 11 extended from the first radiating conductor 3 does not come into contact with the second radiating conductor 4 and the outside conductor 52 of the coaxial cable 5 is connected to part of the second radiating cable 4. Due to this structure, the coaxial cable 5 may be placed in the length direction of the plate antenna 62 as shown in FIG. 17(*a*) or in the width direction of the plate antenna 62 as shown in FIGS. 17(*b*) and (*c*), thereby increasing the freedom in a direction that the coaxial cable 5 can be disposed without being folded.

FOURTH EXAMPLE

Figure 18A:
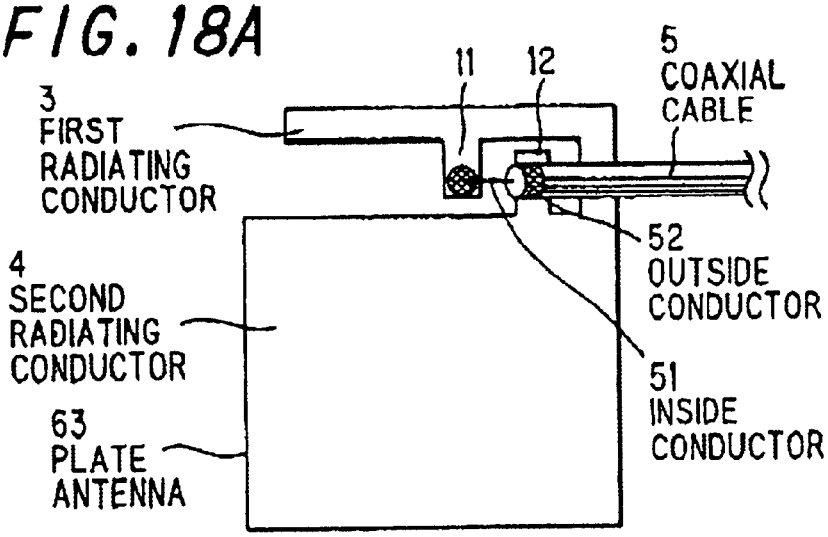
FIG. 18 is a structure diagram of the plate antenna according to a fourth embodiment of the present invention.
Figure 18B:
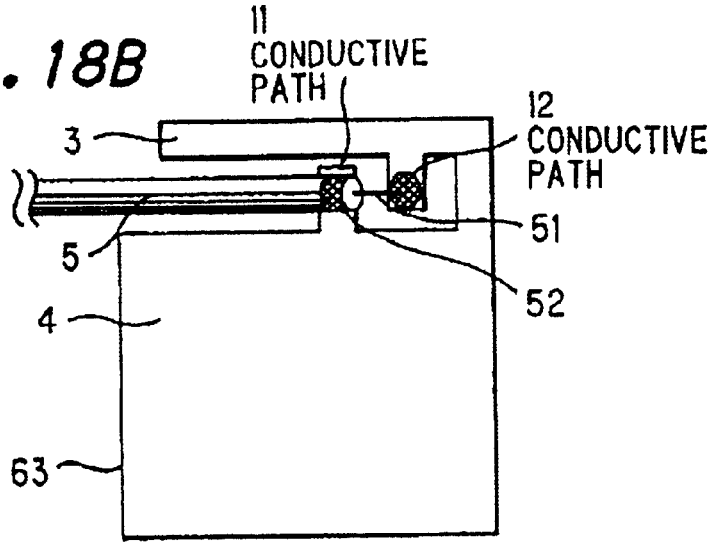

A fourth embodiment of the present invention will be described with reference to FIG. 18. FIG. 18 shows a plate antenna 63 produced by modifying the power supply structure of the plate antenna 61 of the present invention indicated in FIGS. 1 and 2. The conductor path 11 is extended toward the second radiating conductor 4 from a position in which impedance matching is considered of the first radiating conductor 3 and further, a conductor path 12 is also extended toward the first radiating conductor 3 from a position in which impedance matching is considered of the second radiating conductor 4. Then, the inside conductor 51 of the coaxial cable 5 is connected to the conductor path 11 extended from the first radiating conductor 3 which constitutes the slot while the outside conductor 52 of the coaxial cable 5 is connected to the conductor path 12 extended from the second radiating conductor 4. Due to this structure, the coaxial cable can be disposed in the width direction of the plate antenna 63 without being folded.

FIFTH EXAMPLE

Figure 19:
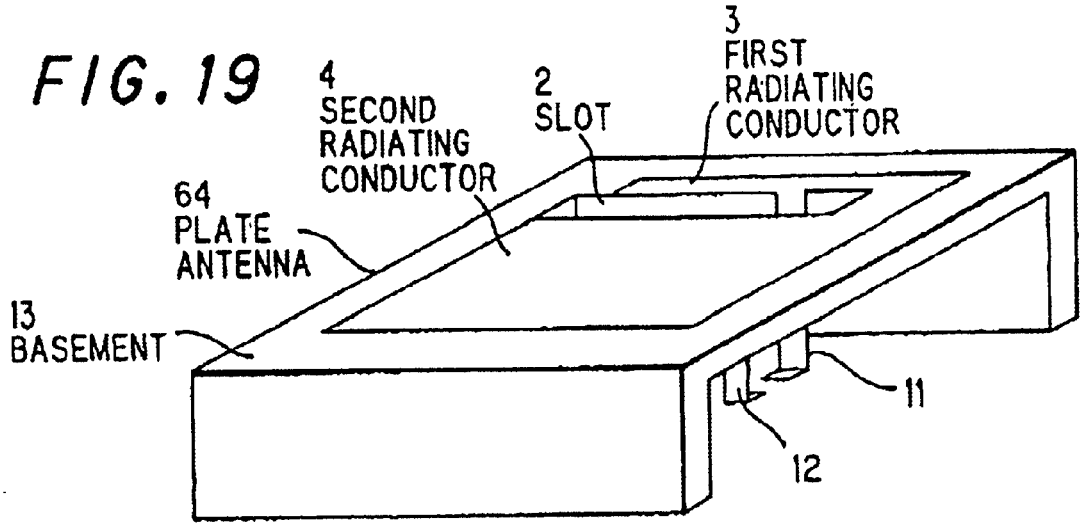
FIG. 19 is a structure diagram of the plate antenna according to a fifth embodiment of the present invention.

A fifth embodiment of the present invention will be described with reference to FIG. 19. FIG. 19 shows a plate antenna 64 of the present invention, constructed on a solid basement 13 having a flat top portion produced by modifying the power supply structure of the plate antenna 61 of the present invention indicated in the examples 1, 2. This plate antenna 64 can be formed according to a processing method of, for example, coating the basement 13 with plating agent. The basement 13 is empty at a portion corresponding to the slot 2 of the plate antenna 64. The conductor path 11 is extended downward from a position in which impedance matching is considered of the first radiating conductor 3 while the conductor path 12 is also extended downward from a position in which impedance matching is considered of the second radiating conductor 4, so as to supply power from under the basement. This structure allows the plate antenna to be incorporated in the portable phone or fixed to a specific location. Meanwhile, the basement 13 is composed of insulator and preferably, its material (dielectric constant) is selected depending upon a desired reduction of the size of the plate antenna 64. It is permissible to employ wiring pattern (not shown) formed on a circuit substrate as a power supply path to the plate antenna 64 and then connect the wiring pattern with the aforementioned conductive paths 11, 12 by mounting the basement 13 on the substrate. In the meantime, the sectional area and length of the conductive paths 11, 12 are set up not to be connected to any outside ground in terms of high frequency.

SIXTH EXAMPLE

Figure 20A:
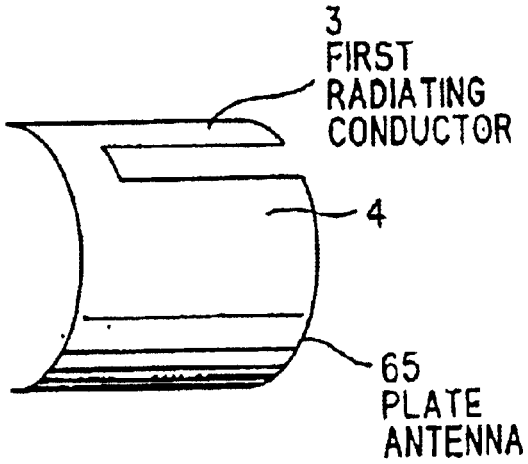
FIG. 20 is a structure diagram of the plate antenna according to a sixth embodiment of the present invention.
Figure 20B:
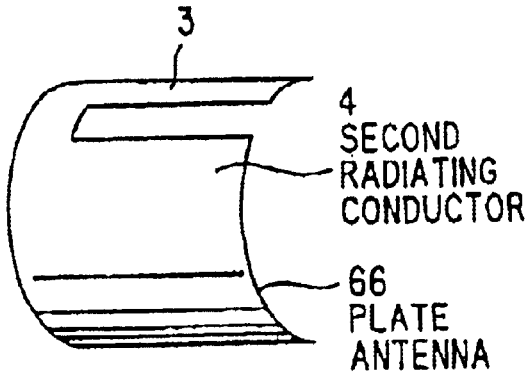

A sixth embodiment of the present invention will be described with reference to FIG. 20. FIG. 20 shows plate antennas 65, 66 in which the shape of the conductive plate is modified solidly depending on the shape or state of the installation position. Both the first radiating conductor 3 and second radiating conductor 4, which construct the plate antennas 65, 66, are processed so that the entire surfaces of the conductive plates are formed in a curved shape.

SEVENTH EXAMPLE

Figure 21A:
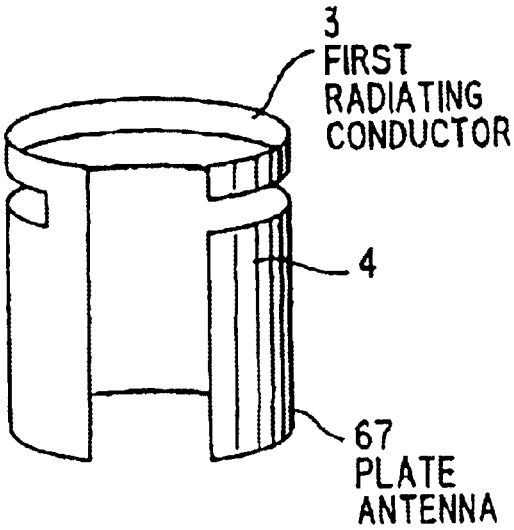
FIG. 21 is a structure diagram of the plate antenna according to a seventh embodiment of the present invention.
Figure 21B:
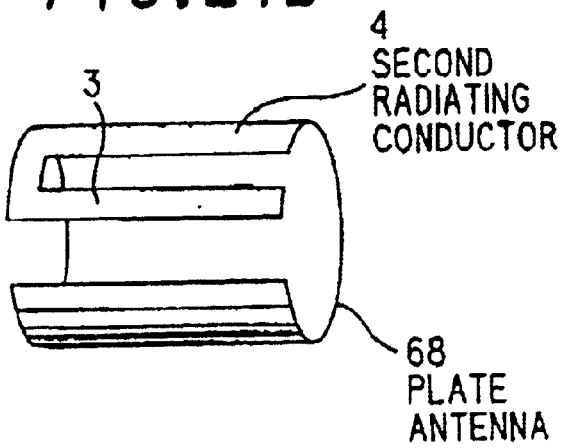

A seventh embodiment of the present invention will be described with reference to FIG. 21. FIG. 21 shows plate antennas 67, 68 produced by modifying the shape of the conductive plate solidly depending upon the configuration and state of the installation position. Both the first radiating conductor 3 and second radiating conductor 4, which construct the slot in each of the plate antennas 67, 68 are processed, so that the conductive plate is formed in a cylindrical shape. The plate antenna 67 shown in FIG. 21(*a*) is bent in the length direction (that is, width direction of the second radiating conductor 4) of the first radiating conductor 3, while the plate antenna 68 shown in FIG. 21(*b*) is bent in the length direction of the conductive plate.

EIGHTH EXAMPLE

Figure 22A:
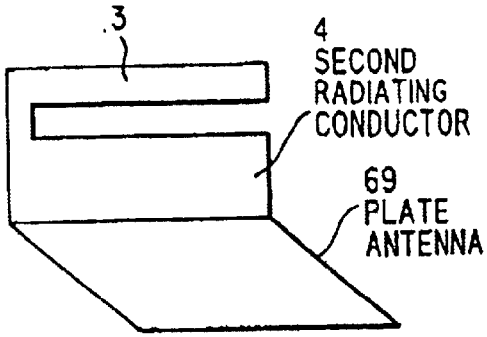
FIG. 22 is a structure diagram of the plate antenna according to an eighth embodiment of the present invention.
Figure 22B:
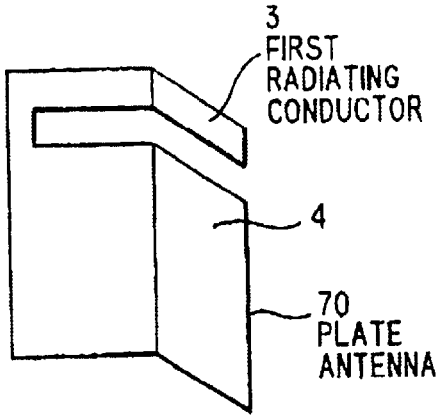
Figure 23A:
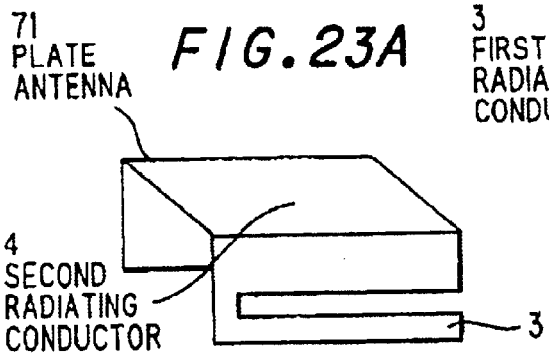
FIG. 23 is a structure diagram of the plate antenna according to a ninth embodiment of the present invention.
Figure 23B:
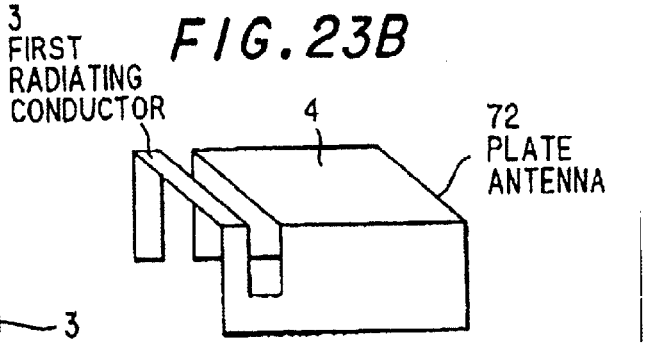
Figure 23C:
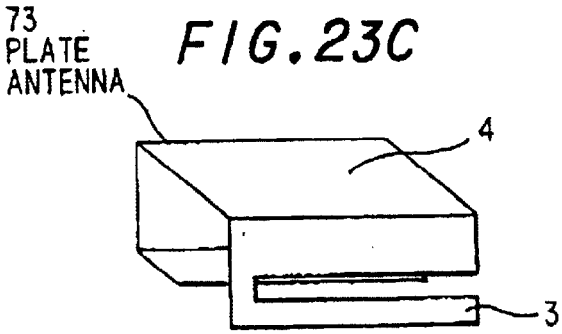
Figure 23D:
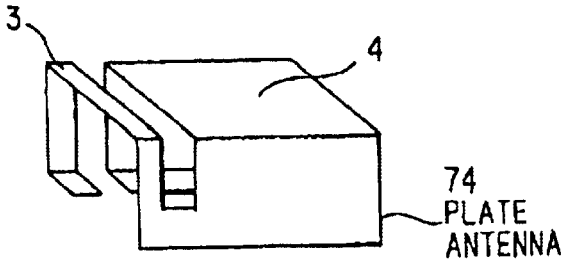

An eighth embodiment of the present invention will be described with reference to FIG. 22. FIG. 22 shows plate antennas 69, 70 produced by modifying the conductive plate solidly depending upon the configuration and state of the installation position. The plate antenna 69 shown in FIG. 22(*a*) is formed such that it is bent along a single folding line in the width direction of the second radiating conductor 4. In the plate antenna 70 shown in FIG. 22(*b*), the first radiating conductor 3 and the second radiating conductor 4 are bent each at a position such that it is bent along a folding line in the length direction of the conductive plate.

NINTH EXAMPLE

A ninth embodiment of the present invention will be described with reference to FIG. 23. FIG. 23 shows plate antennas 71–74 produced by modifying the shape of the conductive plate solidly depending on the configuration and state of its installation position. The plate antenna 71 shown in FIG. 23(*a*) is formed such that it is bent along two folding lines in the width direction of the second radiating conductor 4. The plate antenna 72 shown in FIG. 23(*b*) is formed to be bent along two folding lines in the length direction of the conductive plate so that the first radiating conductor 3 and second radiating conductor 4, which constitute a slot, are bent each at two positions. The plate antenna 73 shown in FIG. 23(*c*) is bent along three folding lines in the width direction of the second radiating conductor 4. The plate antenna 74 shown in FIG. 23(*d*) is formed to be bent along three folding lines in the length direction of the conductive plate so that the first radiating conductor 3 and second radiating conductor 4, which constitute a slot, are bent each at three positions.

TENTH EXAMPLE

Figure 24A:
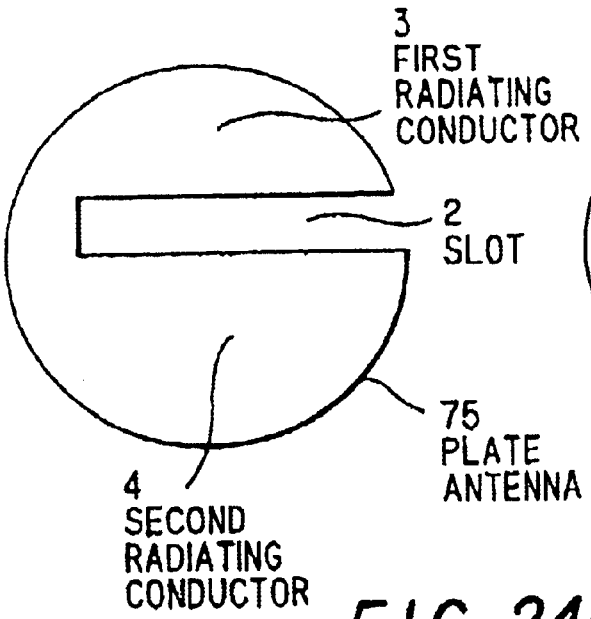
FIG. 24 is a structure diagram of the plate antenna according to a tenth embodiment of the present invention.
Figure 24B:
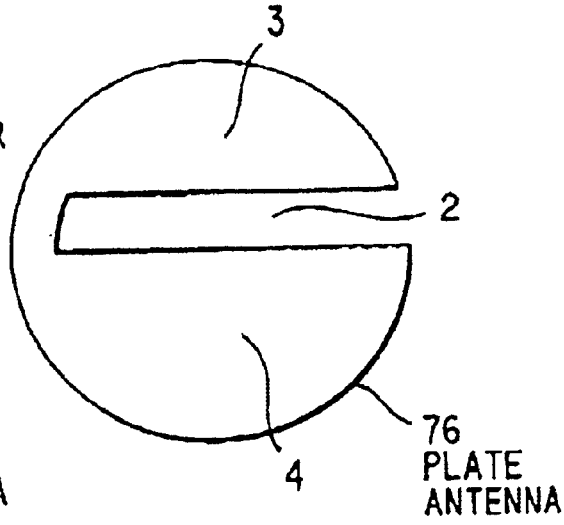
Figure 24C:
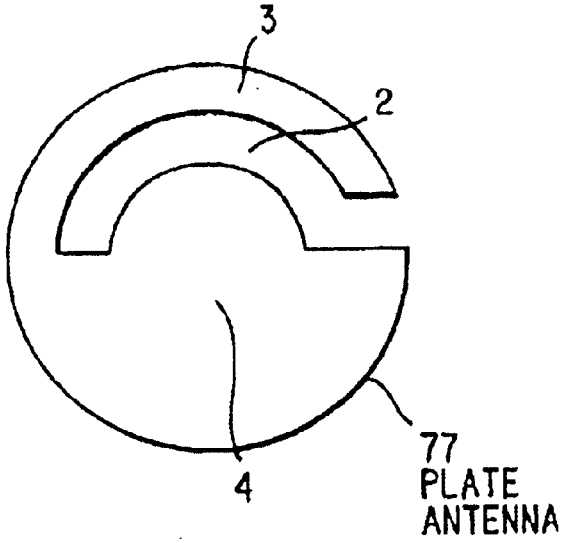

A tenth embodiment of the present invention will be described with reference to FIG. 24. FIG. 24 shows disc-type plate antennas 75–77 in which the shape of its conductive plate is modified depending upon the configuration and state of an installation place such that an outer edge of the conductive plate is circular. In the plate antennas 75, 76 shown in FIGS. 24(*a*) and (*b*), the slot 2 is formed linearly while in the plate antenna 77 shown in FIG. 24(*c*), the slot 2 is formed in a semi-circular shape.

ELEVENTH EXAMPLE

Figure 25A:
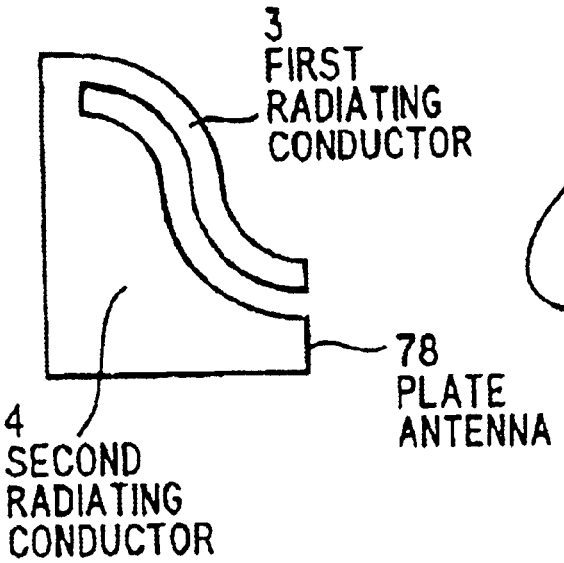
FIG. 25 is a structure diagram of the plate antenna according to an eleventh embodiment of the present invention.
Figure 25B:
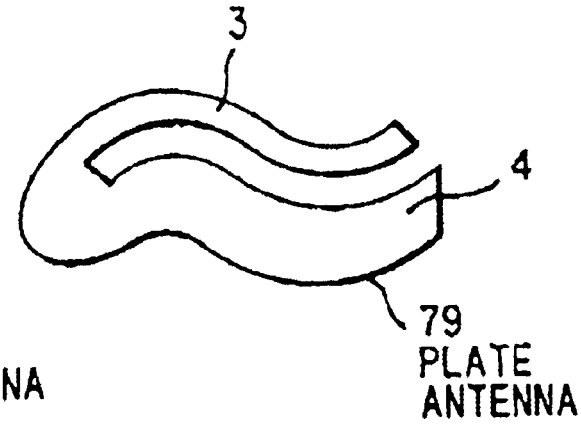
Figure 25C:
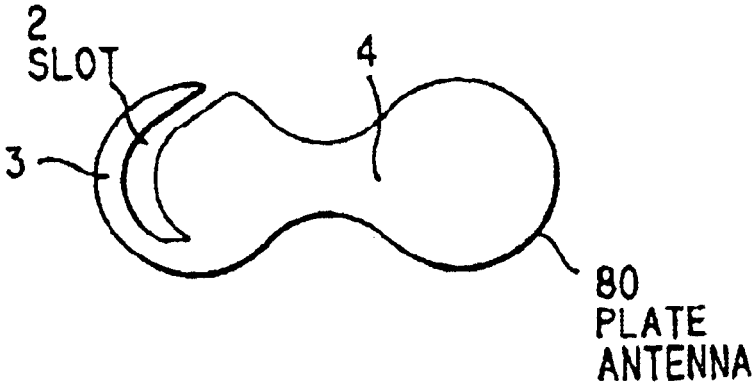

An eleventh embodiment of the present invention will be described with reference to FIG. 25. FIG. 25 shows plate antennas 78–80 in which the shape of its conductive plate is modified depending upon he configuration and state of an installation place such that an outer edge of the conductive plate is curved. In the plate antenna 78 shown in FIG. 25(*a*), the first radiating conductor 3, which constitutes the slot, is formed in S shape, while the side of the second radiating conductor 4 opposing the first radiating conductor 3 is formed along the shape thereof. In the plate antenna 79 shown in FIG. 25(*b*), both the first radiating conductor 3 and the second radiating conductor 4, which constitute the slot, are formed in S shape in the length direction (that is, width direction of the second radiating conductor 4) of the first radiating conductor 3, which constitutes the slot. The plate antenna 80 shown in FIG. 25(*c*) is so formed that an outer edge of its conductive plate is substantially in the shape of glasses, while the slot 2 is formed in a curved shape.

The configuration of the plate antenna is not restricted to those of the above-described respective embodiments, but various kinds of the configurations may be applied depending upon the shape or state of an installation place in which that plate antenna is to be installed. If the shape and position of the slot are determined, the shape of the conductive plate may be modified in various ways. The length of the first radiating conductor 3 only has to be substantially odd times ¼ of the wavelength of electric wave in frequency band for use and does not have to be equal to the width of the second radiating conductor 4.

Consequently, the plate antenna is adaptable for the space and structure of an incorporation position in which that antenna is installed with flexibility, so that reduction of the size is achieved. Further, because the structure of the plate antenna can be selected freely, it can meet a demanded directivity characteristic with flexibility.

Irrespective of whether or not the configuration of the plate antenna is modified, the size of the plate antenna is determined depending upon the wavelength of electric wave in a frequency band actually used when it is incorporated as well as dielectric constant of various kinds of material used for a casing in which the plate antenna is to be installed or the like and an influence of conductive component, in order to obtain an excellent excitation characteristic. If the plate antenna is installed in a casing of an electric appliance, its entire structure is covered with insulation film such as laminate material or conductor is removed from around the plate antenna in order to insulate a connection with a conductive portion in the appliance or a grounding portion in terms of high frequency. As a result, the characteristic of the antenna itself is maintained and an excellent antenna characteristic is obtained.

Figure 26:
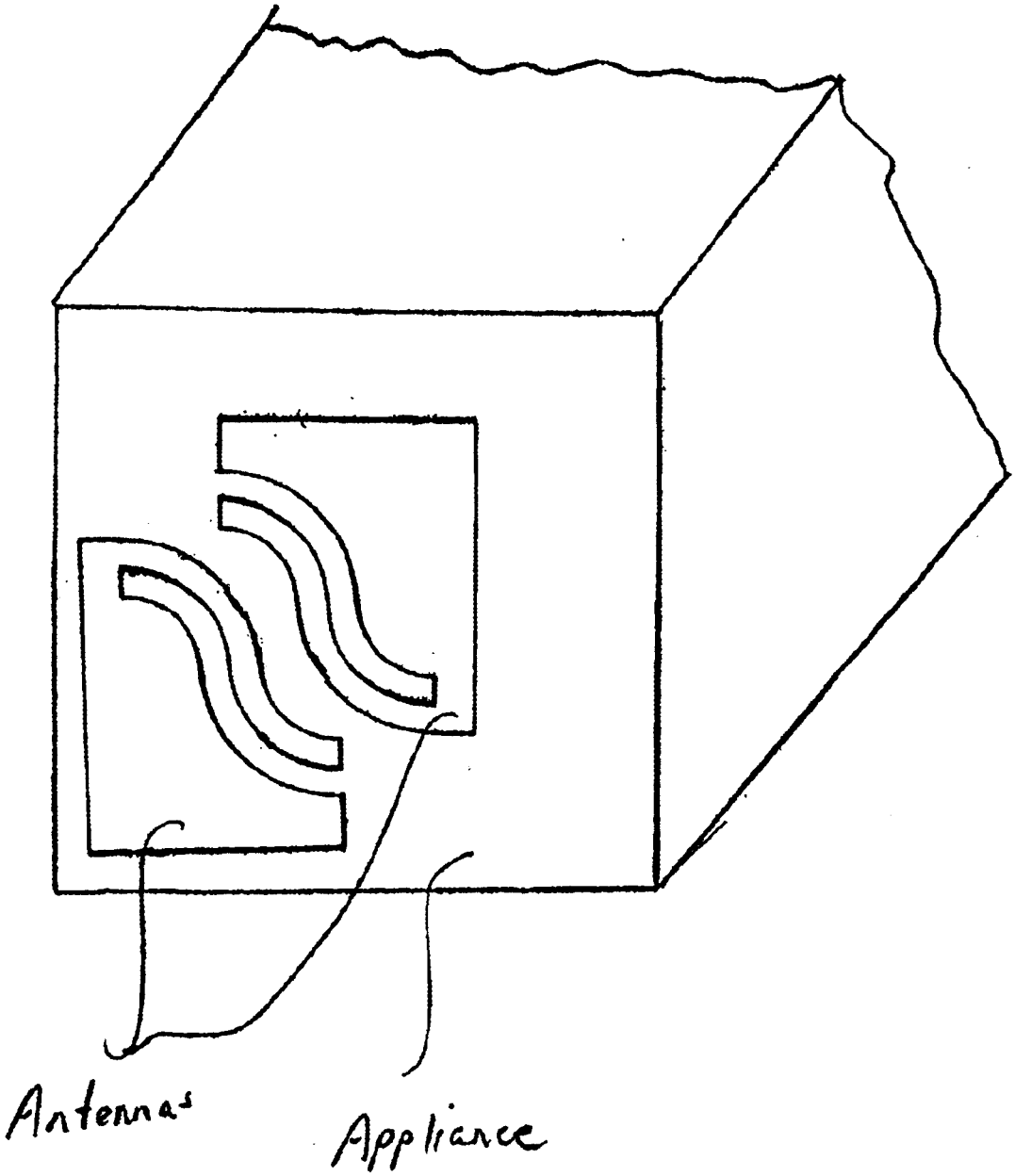
FIG. 26 shows an appliance having multiple antennas.

Further, the plate antenna is capable of suppressing directivity characteristic in a specific direction by shifting the directivity characteristic as indicated in the examples 1, 2. Thus, as shown in FIG. 26, if multiple antennas are installed adjacent to each other, it is possible to restrict electromagnetic interference generated between the adjacent antennas and consequently, the distance between the adjacent antennas can be shorter than in case of ordinary antenna.

The plate antennas of the examples 1–11 of the present invention described above, instead of a conventional externally attached antenna which is installed through an additional cable using a separate casing installed outside a main body casing used in a portable terminal or radio network appliance (electric product) for home use, are capable of eliminating the necessity of removal, reinstallation and readjustment of the antenna, which may occur when it is moved, protecting the antenna itself from a damage and increasing the freedom in the installation position of the portable terminal and electric product. Further, the antennas can be incorporated in a space as small as a gap in the casing without changing the specification of the casing, installation position of each component and the like, which may induce increase of manufacturing cost, prolongation of development period, and therefore, it is possible to provide an antenna whose performance is secured at a lost cost.

According to the present invention, the beneficial effect will be described below.

Therefore, it is possible to provide a plate antenna which can be incorporated in a small space of a portable terminal, electric product, wall or the like and in which its performance is secured at a low cost, and an electric appliance having the same.

What is claimed is:

1. A plate antenna wherein a slot is formed by incising a conductive plate, a first radiating conductor and a second radiating conductor are formed with a center axis in the length direction of the slot as a border, power is supplied through two opposing conductive edges which form the slot, a current distribution generated on the second radiating conductor is defined in a direction different from that of a current distribution generated on the first radiating conductor, and two monopole antennas are electrically composed of the first radiating conductor and the second radiating conductor such that electric waves with different polarized components are radiated by the first radiating conductor and the second radiating conductor.

2. The plate antenna according to claim 1 wherein the conductive plate is formed separately from a grounding portion in a high frequency circuit portion in the appliance in which the antenna is loaded or incorporated or a grounding conductor provided in the appliance.

3. The plate antenna according to claim 1 wherein the slot is formed on a position deflected from the center of the conductive plate and the second radiating conductor has a larger area than the first radiating conductor.

4. The plate antenna according to claim 1 wherein the dimension of the first radiating conductor corresponding to the length direction of the slot is set to substantially odd times ¼ wavelength of electric wave for use.

5. The plate antenna according to claim 1 wherein the width of the slot is set to less than ⅛ the wavelength of electric wave for use.

6. The plate antenna according to claim 1 wherein the conductive plate is covered with insulation film.

7. The plate antenna according to claim 1 wherein a coaxial cable comprised of an inside conductor formed of a single wire or plural stranded wires and an outside conductor located on an outer periphery of the inside conductor acts as a power supply cable while the inside conductor and outside conductor on an end of the coaxial cable are connected to two opposing conductive edges forming the slot.

8. The electric appliance incorporating the plate antenna according to claim 1.

9. The electric appliance provided with or incorporating plural plate antennas according to claim 1 such that the conductive edges each including the slot do not oppose each other.

10. The plate antenna according to claim 1, wherein:

the conductive plate has a substantially square shape.

11. The plate antenna according to claim 1, wherein:

the conductive plate is provided with a non-dielectric substrate.

12. The plate antenna according to claim 11, further comprising:

an appliance;

wherein the conductive plate and the slot are housed within the appliance and the conductive plate is not grounded within the housing.

13. The plate antenna according to claim 11, further comprising:

an insulating film covering the conductive plate.

14. The plate antenna according to claim 11, further comprising:

a coaxial power supply cable having an inner conductor and an outer conductor disposed on an outer periphery of the inner conductor, wherein each of the inner and the outer conductors is connected to a different one of the two opposing conductive edges of the slot.

15. A plate antenna wherein a slot is formed by incising a conductive plate, a first radiating conductor and a second radiating conductor are formed with a center axis in the length direction of the slot as a border, power is supplied through two opposing conductor edges which form the slot, and parts of opposing conductive edges of the slot are extended inward of the slot and power is supplied to the extended parts of opposing conductive edges.

16. A plate antenna wherein a slot is formed by incising a conductive plate, a first radiating conductor and a second radiating conductor are formed with a center axis in the length direction of the slot as a border, power is supplied through two opposing conductive edges which form the slot, and the conductive plate is formed on an insulating basement and parts of the opposing conductive edges of the slot are extended downward of the basement and electrically connected to a wiring pattern formed on a high frequency circuit board.

17. A plate antenna, comprising:

a conductive plate having a first radiating conductor and a second radiating conductor; and a slot formed between the first and the second radiating conductors, the slot having two opposing conductive edges extended inward configured to transfer power to the conductive plate.

18. A plate antenna, comprising:

a base;

a conductive plate connected to the base and having a first radiating conductor and a second radiating conductor; and a slot formed between the first and the second radiating conductors, the slot having two opposing conductive edges extended below the base and configured to transfer power to the conductive plate.

* * * * *